United States Patent [19]

Noda

[11] 4,005,510

[45] Feb. 1, 1977

[54] PLASTIC CLIP

[75] Inventor: Taizo Noda, Nishinomiya, Japan

[73] Assignee: Kohshoh Limited, Kyoto, Japan

[22] Filed: Mar. 4, 1976

[21] Appl. No.: 663,809

[30] Foreign Application Priority Data

Oct. 8, 1975 Japan ..... 50-122228

[52] U.S. Cl. ..... 24/250 R

[51] Int. Cl.[2] ..... A44B 21/00

[58] Field of Search ..... 24/250 R, 250 HE, 242

[56] References Cited

UNITED STATES PATENTS 3,881,228 5/1975 Takabayashi ..... 24/250 HE 3,914,828 10/1975 Noda ..... 24/250 HE

*Primary Examiner*—G. V. Larkin

[57] ABSTRACT

A plastic clip comprises upper and lower plate members each comprising a base plate having a jaw at the front end thereof and being pivotally connected to the other, a spring for holding the jaws in open position and an operating member for holding the jaws in closed position. The jaws of the plate members are kept in closed position by the force substantially parallel to the plate members.

10 Claims, 10 Drawing Figures

PLASTIC CLIP

The present invention relates to a clip, and more particularly to a clip attached to the end of a suspender, a clothes-pin and other similar clips.

Such a clip generally comprises a pair of pivotally connected metal or plastic plate members. In the conventional clip, two plate members are provided with a pivot forming section, in which a pin is inserted, and ends of which are crimped, thereby permitting a pivotal connection. Since clips of this kind are of comparatively small size, formation of the abovementioned pivot gives rise to practical troubles, which has been a large problem in manufacturing these clips. Furthermore, in the conventional clip, two plate members are kept in closed position by a force substantially perpendicular thereto. Therefore, in order to provide the clipping force desired and to have said pivot forming section, clips are inevitably required to have such thickness that they give an uncomfortable touch when worn.

An object of the present invention is to provide a clip which can be easily manufactured and assembled, eliminating the need for a shaft comprising a pin.

Another important object of the present invention is to provide a clip wherein the plate members can be kept in closed position by a force substantially parallel thereto, thus permitting said clip to provide the clipping force desired.

A further important object of the present invention is to provide a clip wherein the construction of pivotal connection between plate members is improved so as to provide substantially smooth and flat outer surfaces and make thinner the total structure thereof, thereby eliminating an uncomfortable touch in wearing and further permitting the touch and an appearance of the clip to be improved.

For achieving these objects, a clip according to the present invention comprises upper and lower plate members, each comprising a base plate provided with a jaw at the front end thereof and being pivotally connected to the other, a spring for holding said jaws in open position and an operating member fitted in said two plate members for holding said jaws in closed position, wherein said upper plate member includes an opening provided at the rear of the corresponding base plate, two opposing side plates each connected to the required portion of each side of the base plate, bearings for the operating member each provided at the rear of the inside surface of said side plate and a shaft having an arcuate surface and extending between said side plates, wherein said lower plate member, comprising said base plate at least the front end of which is adapted to be inserted between the front edge of the opening of said upper plate member and said shaft, includes an upwardly-extending expanded portion located at the rear end of the base plate, the lower surface of said expanded portion being formed into a bearing adapted to engage said shaft for the desired arrangement of the upper and lower plate members, located behind said expanded portion being a projection having a smaller width than said expanded portion and being adapted to carry the operating member, and at either side of the rear end of said projection being provided a first protrusion, wherein said operating member comprises a holding portion and a box which is open at the front and the bottom thereof, is located in front of said holding portion and is adapted to be inserted between the rear edge of the opening and the projection from under said opening, each outside surface of the side walls of said box being provided with a shaft for said operating member for loosely engaging the corresponding bearing for the operating member, wherein said operating member is inserted between the rear edge of the opening and the projection of the lower plate member from under the opening of the upper plate member when the jaws are in open position, said box being formed so as to have a thickness in excess of the distance between the rear edge of the opening and the projection to prevent downward slippage, and on the other hand when the jaws are in closed position, each of said side walls of the operating member is located between the side edge of the opening and the projection and a rear wall of the same between the rear edge of the opening and the rear end of the projection, said box also being formed so that its top and bottom are in substantially the same plane with the upper surface of the base plate of the upper plate member and the lower surface of the base plate of the lower plate member respectively, and wherein the jaws are brought to closed position by downwardly pressing the rear end of the lower plate member and further kept in the same position, namely in closed position by the force substantially parallel to the plate members exerted to the lower portion of the front end of the side wall of the operating member and the upper portion of the outside surface of the rear wall of the same.

These features and advantages of the present invention will become more apparent from the following description with reference to the appended drawings, in which.

Figure 1:
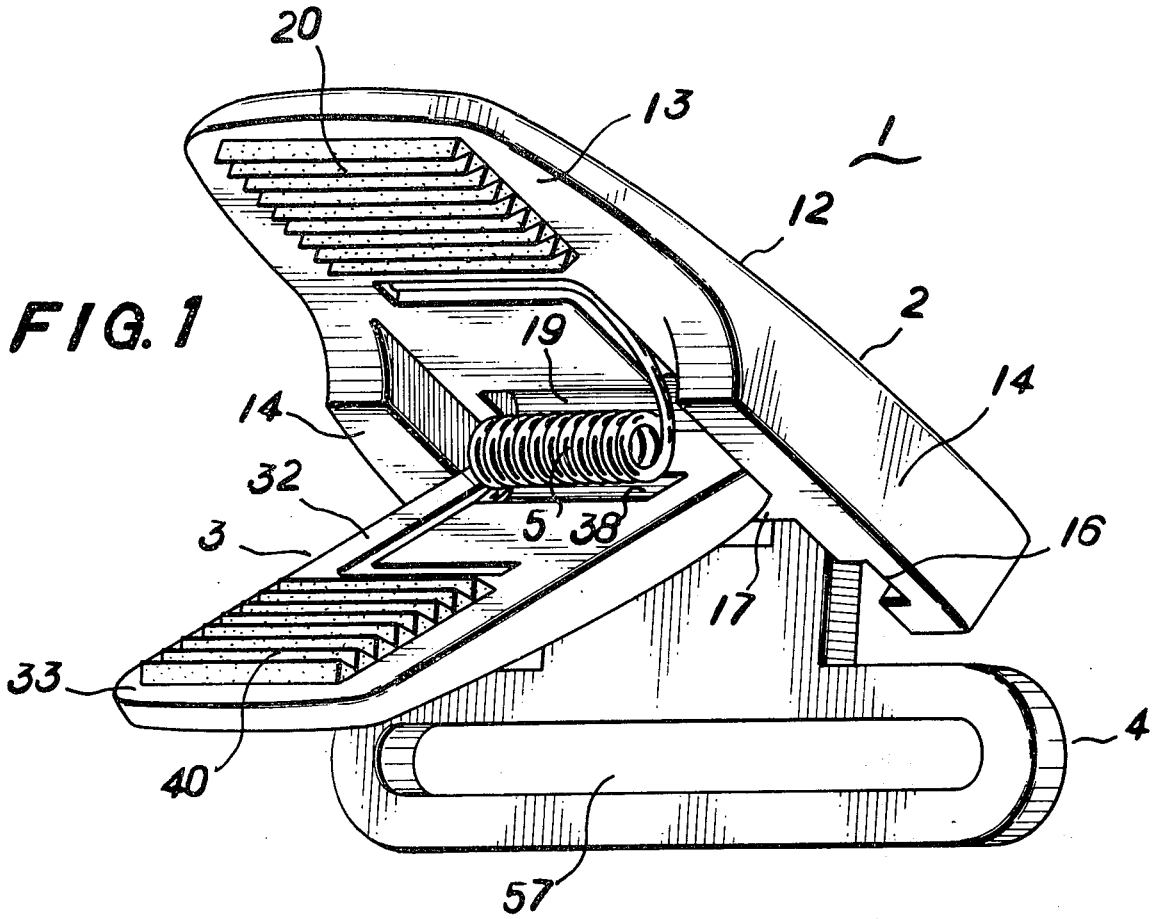
FIG. 1 is a perspective view of an embodiment of a clip according to the present invention.

As shown in FIGS. 1 to 5, a clip 1 comprises upper and lower plate members 2, 3 pivotally connected to each other, a spring 5 for holding the front end portions or jaws 13, 33 of base plates 12, 32 in open position which constitute said upper and lower plate members 2, 3, and an operating member 4 for holding said upper and lower plate members 2, 3 in closed position. These plate members 2, 3 and the operating member 4 are made of plastic material.

Figure 2:
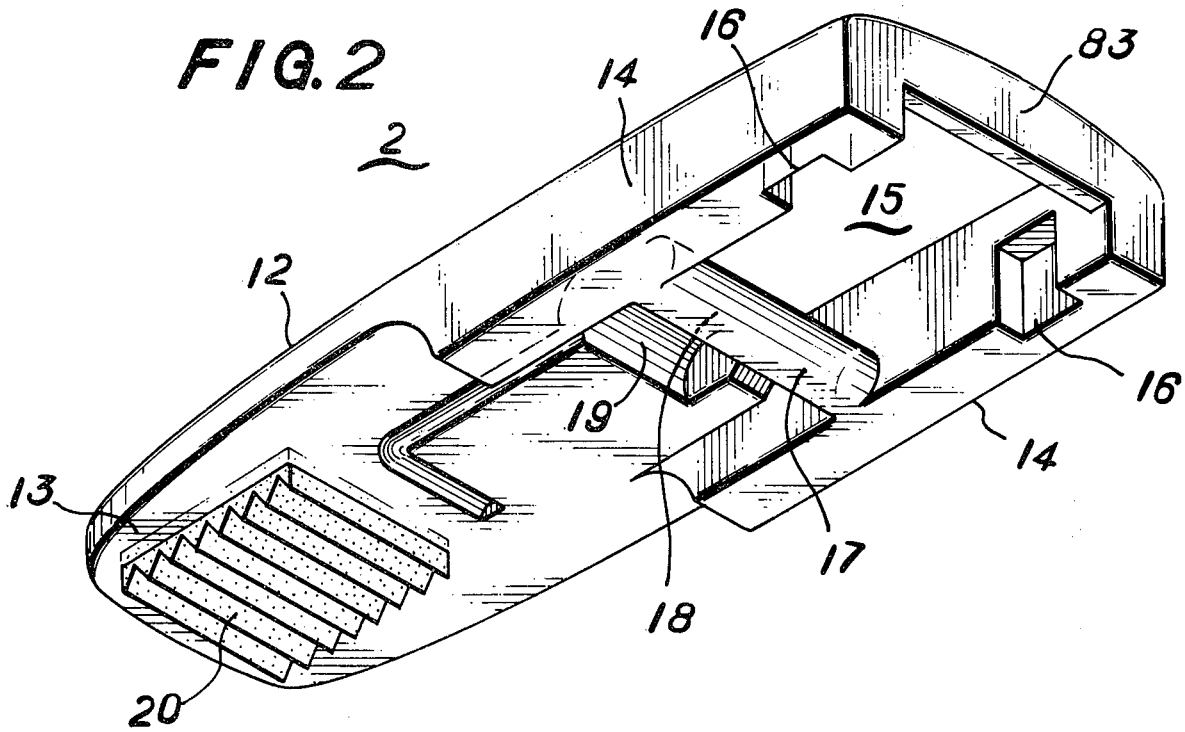
FIG. 2 is a perspective view of an upper plate member of the clip of FIG. 1.

With particular reference to FIG. 2, the upper plate member 2 comprises a pair of side plates 14 connected to the both sides of the base plate 12 except the jaw section 13 thereof, a rectangular opening 15 which is located at the rear of the base plate 12, bearings 16 for the operating member each provided at the rear of the inside surface of said side plate and a shaft 17 having an arcuate upper surface and extending between said side plates, the ends of which are located at the lower half portions of said side plates adjacent to the front edge of said opening. The side plates 14 may extend for the whole length of the base plate 12. But it is also possible of course, as mentioned, that said side plates are provided only at the rear portion of the base plate 12 where the opening 15, bearings 16 for the operating member and the shaft 17 are provided. Further, said shaft 17 is designed so that its lower surface is in the same plane with each of the undersides of the side plates.

Figure 3:
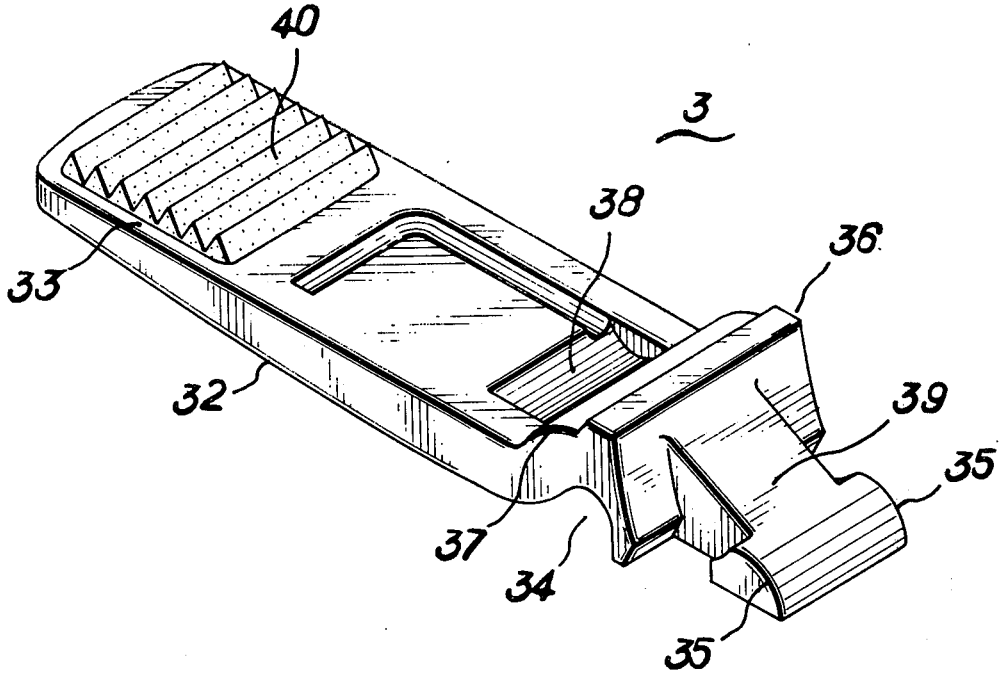
FIG. 3 is a perspective view of a lower plate member of the clip of FIG. 1.

The base plate 32 constituting the lower plate member 3 is adapted to be inserted between the front edge of the opening 15 and the shaft 17. Located at the rear end of said base plate 32 is an upwardly-extending expanded portion 36 which has the same width as said base plate 32. The lower surface of said expanded portion 36 is formed into a lateral groove-like bearing 34 for engaging said shaft 17. Located behind said expanded portion 36 is a projection 39 which has a smaller width than said expanded portion 36 and also has a length insufficient to reach the rear edge of the opening and the shaft and is adapted to carry the operating member 4. At each side of the rear portions of said projection is provided a first protrusion 35 having an arcuate upper and rear surface and being adapted to allow a clearance with respect to the corresponding side plate 14 adjacent to the opening 15. Said first protrusion 35 having an arcuate upper and rear surface may be replaced by a cylindrical protrusion. The lower plate member 3 is inserted forwardly and downwardly between the front edge of the opening 15 and the shaft 17 of the upper plate member 2, said shaft 17 being in engagement with the bearing 34 of the lower plate member 3. The expanded portion 36 serves to prevent the lower plate member 3 from working out forwardly and downwardly from between the front edge of the opening 15 and the shaft 17. A surface 37 of the expanded portion 36 is not limited in form, but it is preferably an arcuate surface, as shown in FIG. 3, which contributes to the smooth opening and closing operation of the upper and lower plate members 2, 3. Further, the expanded portion 36 is constituted so that its top does not protrude beyond the base plate 12, and vice versa when the jaws 13, 33 of the plate members 2, 3 are in closed position. The projection 39 is constituted so that the top 59 of the box 52 is substantially in the same plane with the upper surface of the base plate 12 when the jaws 13, 33 of the plate members 2, 3 are in closed position, said top 59 of the box 52 being superimposed on said projection 39.

Figure 4:
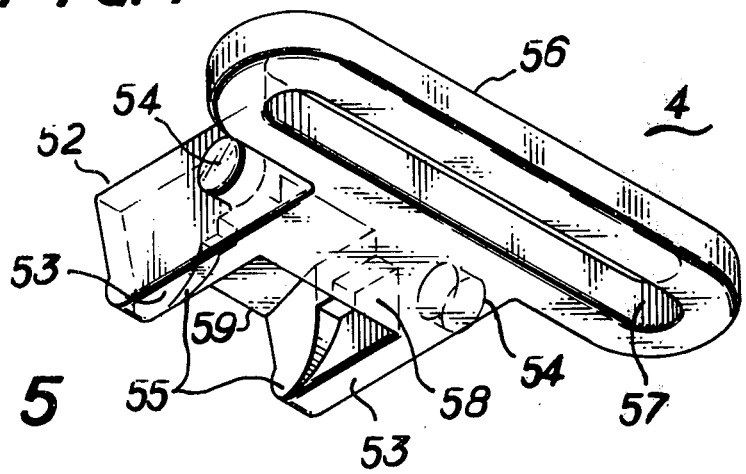
FIG. 4 is a perspective view of an operating member of the clip of FIG. 1.
Figure 5:
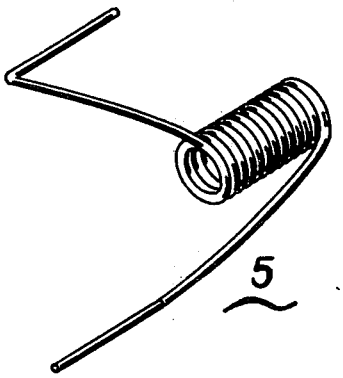
FIG. 5 is a perspective view of a spring of the clip of FIG. 1.

As shown in FIG. 4, the operating member 4 is provided with the box 52 which is connected to the front end of the holding portion 56, is adapted to be inserted between the rear edge of the opening 15 and said projection 39 from under said opening 15 and is open at the front and the bottom thereof, thereby permitting said projection 39 and said first protrusions 35 to be fitted therein. The outside surface of each side wall 53 of said box 52 is provided with a shaft 54 for the operating member for loosely engaging said bearing 16 for the operating member, while the inside surface of the same is provided with a second protrusion 55 at the front portion thereof the rear and lower portions of which are formed so as to have an arcuate surface, said arcuate surface of said second protrusion 55 being in sliding engagement with the arcuate surface of the corresponding first protrusion 35. Said second protrusion 55 is not necessarily required. However, by means of said protrusion 55 the operating member 4 can be operated smoothly. The operating member 4 is inserted between the rear edge of the opening 15 and the projection 39 of the lower plate member 3 from under said opening 15, when the jaws 13, 33 are in open position, said shaft 17 of the upper plate member 2 being in engagement with the bearing 34 of the lower plate member 3.

Therefore, the operating member is formed so that the box 52 has a thickness in excess of the distance between the rear edge of the opening 15 and the projection 39 to prevent the operating member from working out of said opening. The insertion of the operating member can be performed by applying the elasticity of plastics. The operating member 4 comprises the holding portion 56 and the box 52 connected to the front end thereof. The front and the bottom walls of said box are removed so that said projection 39 and said first protrusion 35 are fitted into said box. Further, each of the side walls 53 of said box 52 is positioned between the corresponding side plate 14 adjacent to the opening 15 and the projection 39 while the rear wall 58 of the same is positioned between the rear edge of the opening 15 and the rear end of the projection 39, at least when the jaws 13, 33 are in closed position. The top and the bottom of the box 52 are adapted to be substantially in the same plane with the upper surface of the base plate 12 of the upper plate member 2 and the lower surface of the base plate 32 of the lower base plate respectively, when the jaws 13, 33 of the upper and lower plate members 2, 3 are in closed position.

On the jaw 13 of one base plate 3 is provided a resilient pad 20 with a wavy surface and on the jaw 33 of the other base plate 32 is mounted another resilient pad 40 with a wavy surface. These jaws 13, 33 provided with the resilient pads 20, 40 may be replaced by projections formed integrally with the base plates 12, 32.

The spring 5, which serves to hold the jaws 13, 33 of the upper and lower plate members 2, 3 in open position, is fitted into grooves 19, 38 provided in the substantial middle of each base plates 12, 32, the two ends of said spring 5 being fitted into the longitudinal portions of said grooves 19, 38.

The holding portion 56 of the operating member 4 is provided with a slot for a band, a belt or the like, generally designated 57. Since such a slot 57 serves only to connect a band or the like to the operating member 4 in case of using the clip 1 in a suspender and the like, it may be omitted when the clip 1 is individually used e.g. as a clothespin.

Figure 7:
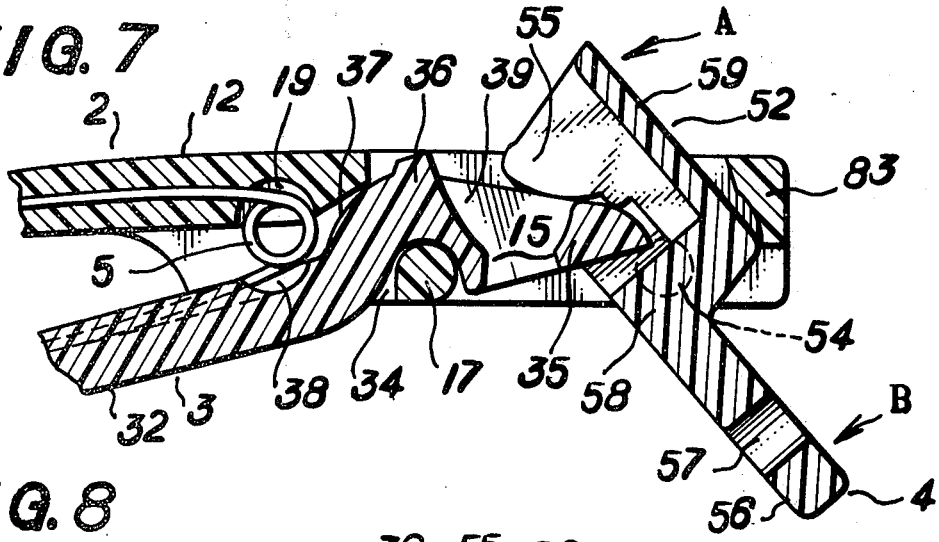
Figure 8:
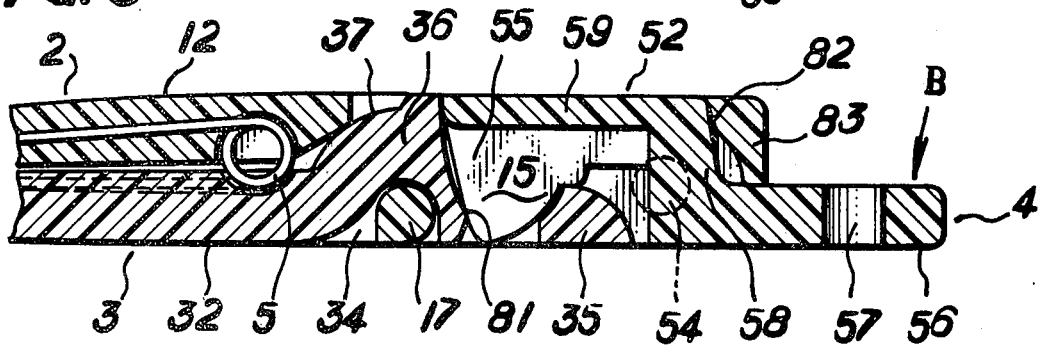

The manner of opening and closing the upper and lower plate members 2, 3 will be explained below particularly with reference to FIGS. 6, 7 and 8.

Figure 6:
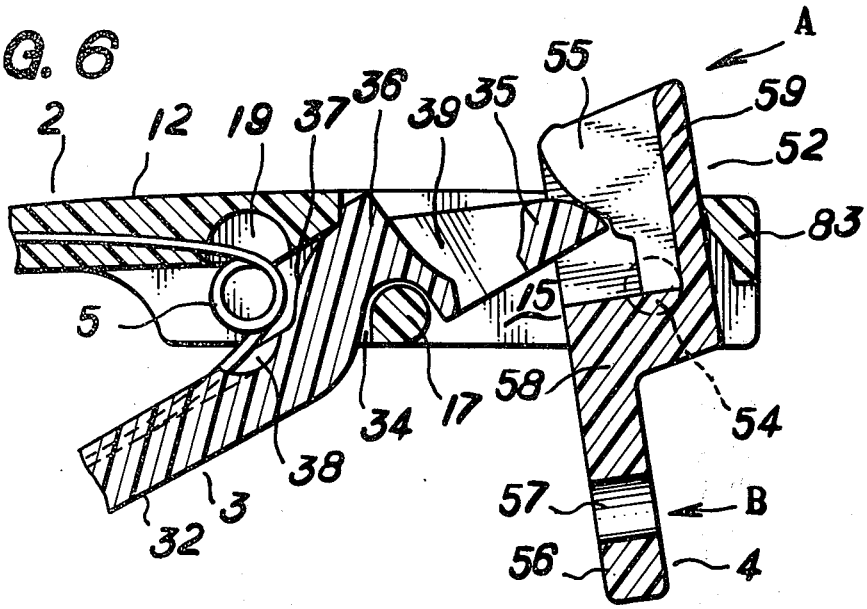
FIGS. 6, 7 and 8 are explanatory views showing the manner in which the upper and lower plate members and the spring illustrated in FIGS. 2, 3, 4 and 5 are operated by the operating member, in FIG. 6 being illustrated a part of the clip in open state, in FIG. 8 being illustrated the same in closed state and in FIG. 7 being illustrated the same in a state halfway between open state and closed state.

Referring to FIG. 6 which illustrates a part of the clip 1 in open position, the operating member 4 is pushed upward by the resilient force of the spring 5 without applying a force B thereon, that is, the box 52 of the operating member 4 is pushed upward by a force produced in the engaging portions of the first and second protrusions 35, 55 and is kept in a position substantially perpendicular to the upper plate member 2, thereby permitting the jaws 13, 33 of the two plate members 2, 3 to be completely kept in open position. Then, when a force A pressing downwardly on the rear end of the lower plate member 3 is applied on the operating member 4 against the resilient force of the spring 5, the second protrusions 55 of the operating member 4 slide along the upper surface of the first protrusions 35 of the lower plate member 3 while at the same time the rear wall 58 of the box 52 slides along the inside surface of the rear plate 83 of the opening 15, as shown in FIG. 7, whereby the outer surface of said rear wall 58 comes into close contact with the inner surface of the rear plate 83. And finally when the operating member 4 is put in a desired position, namely in a position as shown in FIG. 8, the jaws 13, 33 of the two plate members 2, 3 are kept in closed position. In other words, on the contacting surface 81 between the lower portion of the rear end of the lower plate member 3 and the lower portion of the front end of each side wall 53 constituting the box 52 of the operating member 4 and also on the contacting surface 82 between the upper portion of the rear wall 58 of said box 52 and the upper portion of the rear plate 83 of the upper plate member 2 is exerted a force substantially parallel to the plate members 2, 3, thereby permitting the jaws 13, 33 to be kept in closed position. That is to say, in case of the jaws 13, 33 being in closed position, the clip has a structure of a lever as generally known, in which the jaws 13, 33 act as points of application, the shaft 17 as a fulcrum and the contacting surface 81 as a point of force. On the other hand, the movement of the jaws 13, 33 from closed position to open one can be achieved by downwardly applying the force B on the operating member 4, as shown in FIG. 8.

Figure 9:
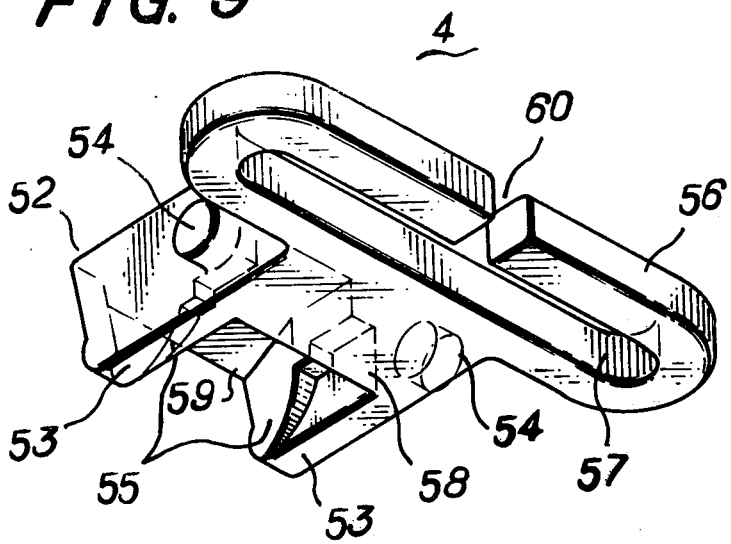
FIG. 9 is a perspective view of a modified embodiment of the operating member.

Referring to FIG. 9, there is shown a modified embodiment of the holding portion 56 of the operating member 4, which is provided with a cutaway portion 60 having a predetermined width, being connected to said slot 57 and being positioned substantially in the middle of the longitudinal rear part thereof. Said cutaway portion 60 is provided for the purpose of facilitating connecting a band or the like to the clip 1 in case of using the clip in a suspender and the like. That is, one end of a band or the like can pass through said cutaway portion 60 to be fitted through the slot 57. In the case of a band or the like having its one end in the form of a closed loop, such a band or the like can be easily connected to the slot 57.

Figure 10:
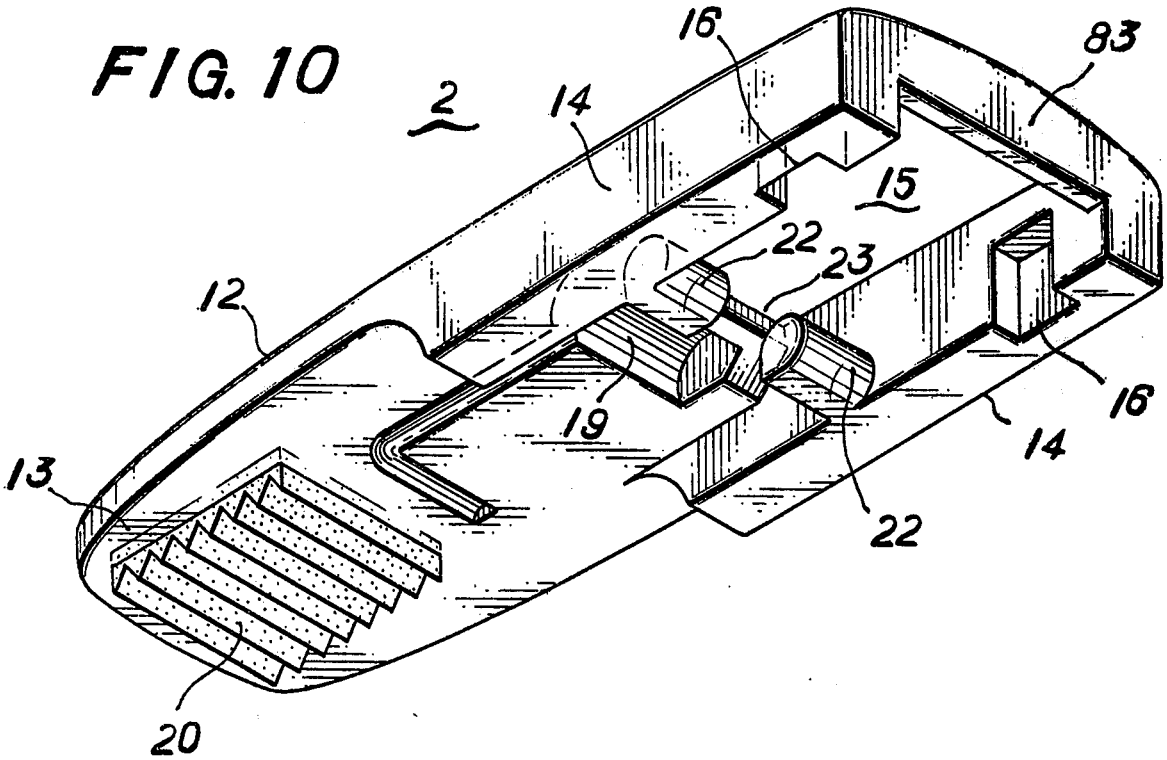
FIG. 10 is a perspective view of a modified embodiment of the upper plate member.

Referring now to FIG. 10, there is shown a modified embodiment of the shaft 17 of the upper plate member 2 which is shown in FIG. 2. The substantial middle of said shaft for engaging the bearing 34 of the lower plate member 3 is provided with a cutaway portion 23 having a predetermined width. It will be observed, therefore, that said shaft 17 comprises two separate shafts protruding from the side plates 14.

As mentioned above, a clip according to the present invention has a simple structure without the need of a shaft comprising a pin which is required by conventional clips, thus making the manufacture of the clip extremely easy. Furthermore, a clip according to the present invention has substantially flat outer surfaces or flat upper, lower and two side surfaces, thereby providing a good feel in wearing and an excellent appearance.

Further, a clip according to the present invention has a simple structure in which its jaws are kept in closed position by a force extending substantially parallel to the plate members, thereby allowing the clip to be thinner and of extremely small size.

What I claim is:

1. A plastic clip comprising upper and lower plate members each comprising a base plate provided with a jaw at the front end thereof and being pivotally connected to the other, a spring for holding said jaws in open position and an operating member fitted in said two plate members for holding said jaws in closed position, wherein said upper plate member includes an opening provided at the rear of the corresponding base plate, two opposing side plates each connected to the required portion of each side of the base plate, bearings for the operating member each provided at the rear of the inside surface of said side plate and a shaft having at least an arcuate surface and extending between said side plates, wherein said lower plate member, comprising said base plate at least the front end of which is adapted to be inserted between the front edge of the opening of the upper plate member and said shaft, includes an upwardly-extending expanded portion located at the rear end of the base plate, the lower surface of said expanded portion being formed into a bearing adapted to engage said shaft for the desired arrangement of the upper and lower plate members, a projection located behind said expanded portion and having a smaller width than said expanded portion and being adapted to carry the operating member, and a first protrusion being provided at either side of the rear end of said projection wherein said operating member comprises a holding portion and a box which is open at the front and the bottom thereof, is located in front of said holding portion and is adapted to be inserted between the rear edge of the opening and the projection from under said opening, each outside surface of the side walls of said box being provided with a shaft for said operating member for loosely engaging the corresponding bearing for the operating member, wherein said operating member is inserted between the rear edge of the opening and the projection of the lower plate member from under the opening of the upper plate member when the jaws are in open position, said box being formed so that it has a thickness in excess of the distance between the rear edge of the opening and the projection to prevent downward slippage, and on the other hand when the jaws are in closed position, each of said side walls of the operating member being located between the side edge of the opening and the projection and a rear wall of the same between the rear edge of the opening and the rear end of the projection, said box also being formed so that its top and bottom are in substantially the same plane with the upper surface of the base plate of the upper plate member and the lower surface of the base plate of the lower plate member respectively, and wherein the jaws are brought to closed position by downwardly pressing the rear end of the lower plate member and further kept in the same position, namely in closed position by force substantially parallel to the plate members exerted to the lower portion of the front end of the side wall of the operating member and the upper portion of the outside surface of the rear wall of the same.

2. A plastic clip as claimed in claim 1, wherein said shaft of the upper plate member is formed so that its lower surface is in the same plane with each of the undersides of said side plates, and wherein said expanded portion is formed to provide enough width to prevent the forward and downward slippage of said lower plate member from between the front edge of the opening and the shaft and to provide an arcuate upper surface.

3. A plastic clip as claimed in claim 1, wherein each of said first protrusions of the lower plate member is so formed as to have fan-shaped side faces.

4. A plastic clip as claimed in claim 1, wherein each of said first protrusions of the lower plate member is shaped like a cylinder.

5. A plastic clip as claimed in claim 1, wherein each inside surface of the side walls of said box is provided at the front portion thereof with a second protrusion the rear and lower portions of which are so formed as to have an arcuate surface, said first protrusions being in engagement with said second protrusions, thereby permitting the plate members to perform the opening and closing operation.

6. A plastic clip as claimed in claim 1, wherein said holding portion of the operating member is provided with a slot for fitting one end of a band, a belt or the like therethrough.

7. A plastic clip as claimed in claim 1, wherein each of the jaws of said base plates is provided with an anti-slipping means.

8. A plastic clip as claimed in claim 1, wherein said holding portion of the operating member is provided with a cutaway portion having a predetermined width, being connected to said slot and being positioned substantially in the middle of the longitudinal rear part thereof.

9. A plastic clip as claimed in claim 1, wherein the gap between said side plates of the upper plate member is bridged by means of said shaft of the same.

10. A plastic clip as claimed in claim 1, wherein said shaft of the upper plate member comprises two separate shafts protruding from the side plates of the same and being in alignment with each other.

* * * * *